US006182998B1

(12) United States Patent
Huyghe et al.

(10) Patent No.: US 6,182,998 B1
(45) Date of Patent: Feb. 6, 2001

(54) SHOCK-ABSORBING DEVICE FOR A SKI OR THE LIKE

(75) Inventors: Christian Huyghe, Gruffy; Axel Phelipon, Alby sur Cheran, both of (FR)

(73) Assignee: Salomon S.A., Metz-Tessy (FR)

( * ) Notice: Under 35 U.S.C. 154(b), the term of this patent shall be extended for 0 days.

(21) Appl. No.: 08/875,497

(22) PCT Filed: Nov. 27, 1996

(86) PCT No.: PCT/FR96/01876

§ 371 Date: Aug. 1, 1997

§ 102(e) Date: Aug. 1, 1997

(87) PCT Pub. No.: WO97/20604

PCT Pub. Date: Jun. 12, 1997

(30) Foreign Application Priority Data

Dec. 4, 1995 (FR) ..... 95 15108

(51) Int. Cl.[7] ..... A63C 5/07
(52) U.S. Cl. ..... 280/602
(58) Field of Search ..... 280/602, 601, 280/607, 11.14

(56) References Cited

U.S. PATENT DOCUMENTS

| | | | | |
|---|---|---|---|---|
| 3,537,717 | * | 11/1970 | Caldwell | 280/11.13 |
| 4,679,813 | * | 7/1987 | Girard | 280/602 |
| 4,824,926 | * | 4/1989 | O'Dwyer | 528/65 |
| 5,284,357 | * | 2/1994 | Tinkler | 280/602 |
| 5,342,077 | | 8/1994 | Abondance et al. . | |
| 5,417,448 | * | 5/1995 | Le Masson et al. | 280/602 |
| 5,458,372 | * | 10/1995 | Goode | 280/819 |
| 5,464,242 | * | 11/1995 | Commier | 280/602 |
| 5,470,094 | | 11/1995 | Commier et al. . | |
| 5,474,109 | * | 12/1995 | Stoeppelmann | 138/137 |
| 5,556,677 | * | 9/1996 | Quigley | 428/36.2 |
| 5,597,170 | | 1/1997 | Le Masson et al. . | |

FOREIGN PATENT DOCUMENTS

| | | | | |
|---|---|---|---|---|
| 0 560 695 A1 | * | 9/1993 | (EP) | 280/602 |
| 0639391 | | 2/1995 | (EP) . | |
| 0682961 | | 11/1995 | (EP) . | |
| 1526418 | * | 4/1968 | (FR) | 280/602 |
| 2575393 | | 7/1986 | (FR) . | |
| 2665081 | | 1/1992 | (FR) . | |
| 2675392 | | 10/1992 | (FR) . | |
| 2729865 | | 2/1995 | (FR) . | |

* cited by examiner

*Primary Examiner*—Kevin Hurley
*Assistant Examiner*—Kevin McKinley
(74) *Attorney, Agent, or Firm*—Greenblum & Bernstein P.L.C.

(57) ABSTRACT

A shock-absorbing device for a gliding board. The gliding board includes two laterally spaced apart transmission rods; at least one fixed connection making it possible to rigidly connect the first ends of both rods to the gliding board; and at least one casing adapted to be connected rigidly to the board at a certain distance from the fixed connection, which has an opening for the introduction of an inserted portion of each rod, and at least one housing containing a viscoelastic material which is in contact with the longitudinal sliding surface along at least a certain length of the insertable portion of each rod in the housing, the material being biased in shearing during the displacement of each rod portion in the housing. An object of the invention is to provide a device that absorbs both the flexional and torsional forces of the portions of a gliding board that are the most exposed to these phenomena.

26 Claims, 5 Drawing Sheets

12
3
10
1
23
21b
20b
2
V
V
D
IV
IV
20
21
20a
21a
III
III
22
11
P 231a
21b
21
23
231b
20b
20
1
4

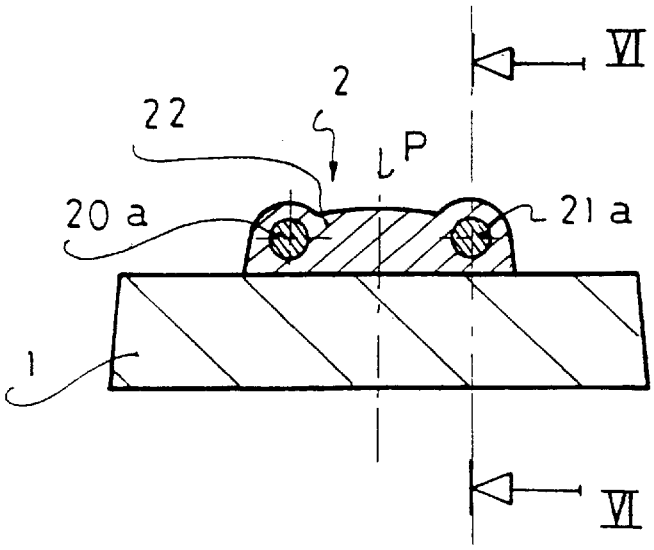
Fig: 3
Fig: 4
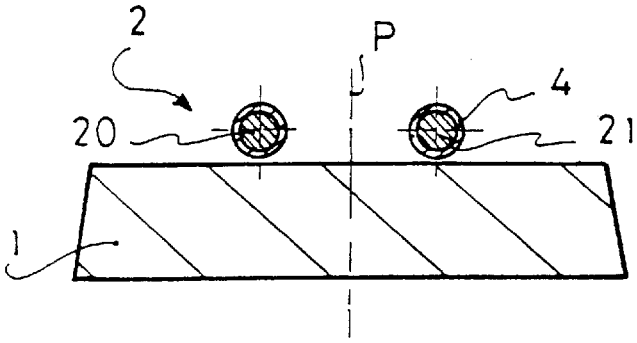
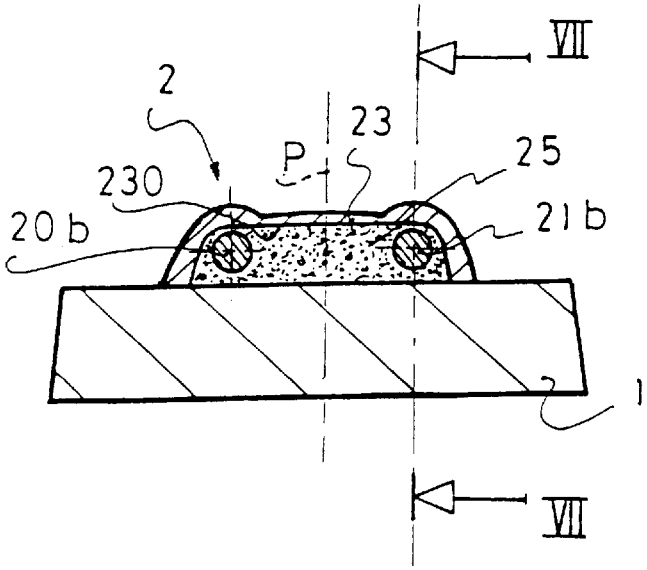
Fig: 5

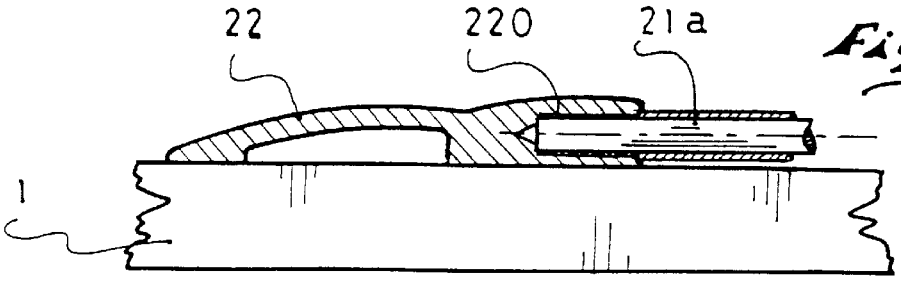
Fig: 6
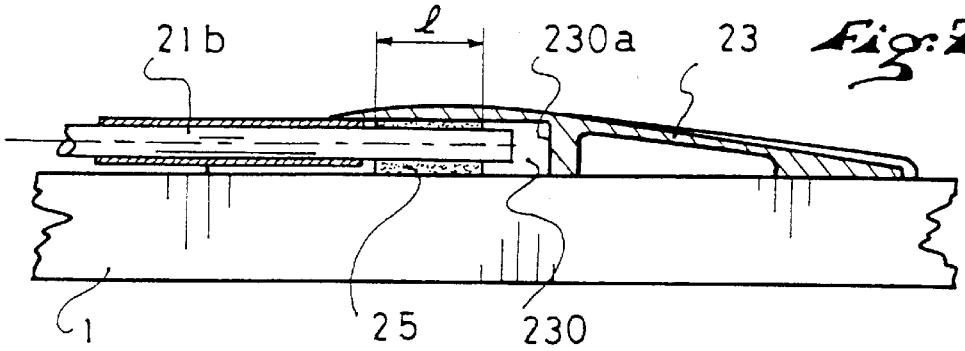
Fig: 7
Fig: 8
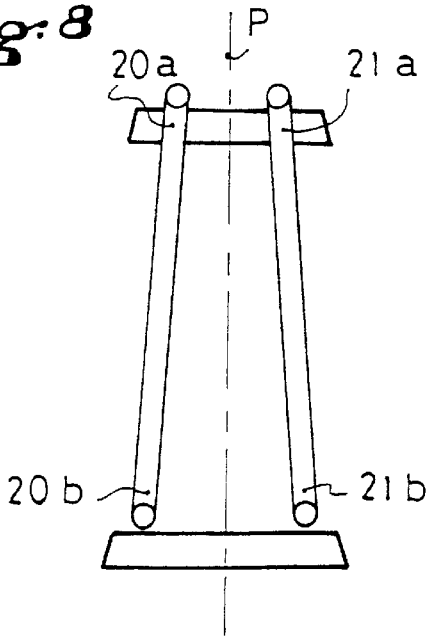
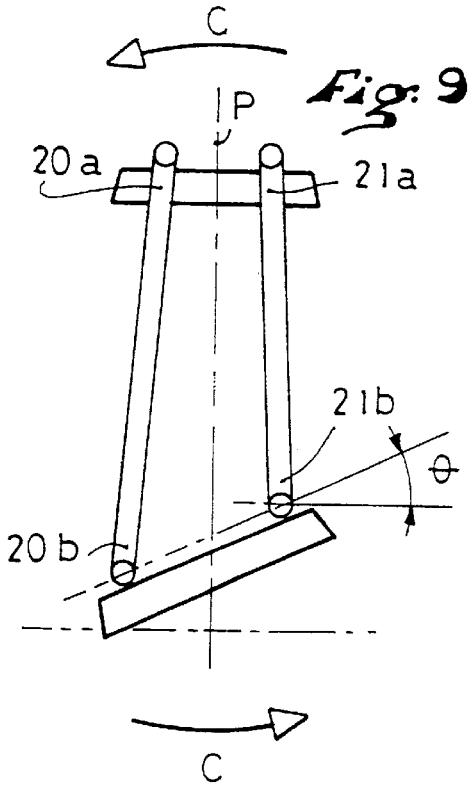
Fig: 9

SHOCK-ABSORBING DEVICE FOR A SKI OR THE LIKE

BACKGROUND OF THE INVENTION

The invention relates to a shock-absorbing device for gliding boards, such as an alpine ski, a cross-country ski, a monoski, or a snowboard. It relates as well to a ski equipped with such a device.

DESCRIPTION OF BACKGROUND AND RELEVANT INFORMATION

While on the snow, the currently available skis are subjected to shocks or more or less extended bending stresses which cause the ski to vibrate. These vibrations are for the most part negative parasitic effects which cause the loss of adherence between the ski and the snow, which adversely affects the steering and stability of the ski.

Various solutions have already been proposed in order to improve the vibrational behavior of a ski. The document FR-A-2 575 393 proposes to arrange a device of shorter length with regard to the supporting length of the ski and its positioning occurs in the zones that are predetermined as a function of the types of vibration which it is desirable to absorb.

Another more recently published solution in the document FR-A-2 675 392 consists of taking up the flexion forces applied to the ski through one flexion blade of which one end is fixed to the ski and the other end is linked to an interface made of a viscoelastic material which is subjected to the shearing of the blade. The interface can either be connected directly above the ski, or can be attached to the inner surface of a stirrup or of a protection spoiler.

One of the main advantages of such a design is to obtain a satisfactory shock-absorption of the vibrations by using a system whose height space requirement on the ski is reduced to a minimum. The shock-absorbing effect is accompanied by a dynamic stiffening of the ski, a function of the length of the flexion blade and of the shear strength opposing the free end of the ski. Conversely, the static rigidity of the ski is not affected by the arrangement of such a system since no prestress is opposed to the free end by the shock-absorption means which operates in shearing.

However, the bending stresses are not the only stresses which appear when operating the ski.

When the ski is moving on the snow, it is subjected to three types of fundamental stresses: the bending stresses, the torsional stresses and the stresses of "lateral deformation." In addition to these stresses, the vibrating phenomena occur at certain speeds as a function of irregularities of the terrain, which in turn generates flexional and torsional deformation of the ski in various ways.

The torsional stresses or vibrational phenomena of the ski appear either in raised regions, or more frequently in turns when the downhill ski imparts substantial pressure on the inner edge. It can also be observed that the torsional stresses are maximum on the external zones of the ski and are for the most part oriented at a 45 degree angle with respect to the longitudinal axis. Furthermore, the stresses vary along the ski and increase in the direction of each of the ends, at the shovel and tail. Unusually larger skis, such as powder snow skis, are subjected to more stress at the ends; and there does not exist any device which permits the stresses to be absorbed in an efficient manner.

None of the prior art devices provide a satisfactory solution for diminishing the various stresses and vibratory phenomena.

SUMMARY OF THE INVENTION

The object of the present invention is thus to propose a device which absorbs both flexional deformation and torsional deformation of the portions of the gliding board that are most exposed to these phenomena.

To this end, the invention concerns a shock-absorbing device for a gliding board. The device includes:

two transmission rods laterally spaced apart, at least one fixed connection making it possible to rigidly connect the first ends of both rods to the gliding board, at least one casing adapted to be connected rigidly to the board at a certain distance from the fixed connection, which has an opening for the introduction of a retractable portion of each rod, and a housing containing a viscoelastic material which is in contact with the longitudinal sliding surface along a certain length, at least, of the retractable portion of each rod; said material being biased in shearing during the displacement of each rod portion in the housing.

According to another characteristic of the invention, the two rods are oriented with respect to each other in a substantially parallel manner.

The invention equally relates to a ski, particularly of the alpine type, including the shock-absorbing device. The transmission rods are oriented substantially in the longitudinal direction, each being offset on either side of the vertical median plan P. The more the rods are laterally offset in relation to this plane, the more the torsional shock-absorbing effect proves efficient.

Thus, the device is particularly sensitive to flexional deformations of the elongated beam which constitutes the ski, as well as to torsional deformations thereof. The device is also particularly adapted to powder snow skis, whose front and rear widths are greater than normal.

According to a complementary characteristic, the ski includes a first device located between the shovel zone and the mounting zone of the bindings, and a second device located between the mounting zone of the bindings and the tail zone.

It is in these areas, in effect, that the bending is maximum, whereas it is necessary to improve the contact between the ski and the snow.

BRIEF DESCRIPTION OF THE DRAWINGS

Other characteristics and advantages of the invention will become apparent from the description which follows, with reference to the annexed drawings which are only provided by way of non-limiting examples, and in which:

FIG. 3 is a cross-section along III—III of FIG. 1.

FIG. 4 is a cross-section along IV—IV of FIG. 1.

FIG. 5 is a cross-section along V—V of FIG. 1.

FIG. 6 is a cross-section along VI—VI of FIG. 3.

FIG. 7 is a cross-section along VII—VII of FIG. 5.

FIGS. 8 and 9 are schematic views of the working principle of the device during torsion.

DETAILED DESCRIPTION OF THE INVENTION

Figure 1:
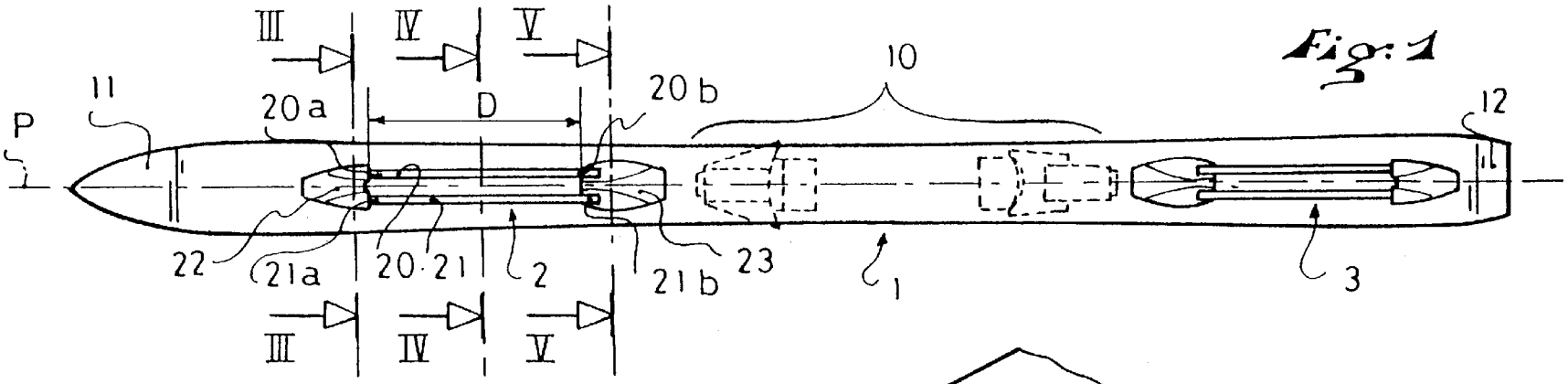
FIG. 1 is a top view of a ski on which two devices are mounted according to the invention.

FIG. 1 shows a ski 1, in particular an alpine ski, constituted by an elongated beam having its own distribution of thickness, of width and, therefore, its own stiffness. It includes a central portion or mounting zone 10 adapted for the mounting of the binding elements (dotted lines), a shovel zone 11 located at the front of the ski, a tail zone 12 located in the rear of the ski.

A first device 2 according to the invention is located on the upper surface of the ski between the mounting zone 10 and the shovel zone 11. Likewise, a second device 3 is located on the upper surface between said zone 10 and the tail zone 12. This arrangement allows for shock-absorption at the front and rear portions of the ski which are the most biased during flexional and torsional deformation.

The following detailed description of the device 2 of the front of the ski therefore applies to in the same manner to device 3 in the rear of the ski. The shock-absorption device 2 includes two transmission rods 20, 21 substantially parallel to one another and located on both sides of the median vertical plane P. These rods are laterally spaced from one another, i.e., in a direction perpendicular to the longitudinal direction set out by the median vertical plane P. Each rod 20, 21 includes a first end 20*a*, 21*a* connected to a fixed connection 22 which firmly holds these ends on the ski without any possibility of movement.

The second ends 20*b*, 21*b* of the rods are connected to the ski by a flexible connection which includes a casing 23 rigidly connected to the ski. Between the connection 22 and the casing 23, along the distance D shown, the rods are perfectly free and have no connection with the ski. One can however tolerate the addition of a means for guiding longitudinal displacements, for example, to avoid a possible problem of buckling of the rods, which can occur during an exceptional flexional deformation (not shown).

Figure 2:
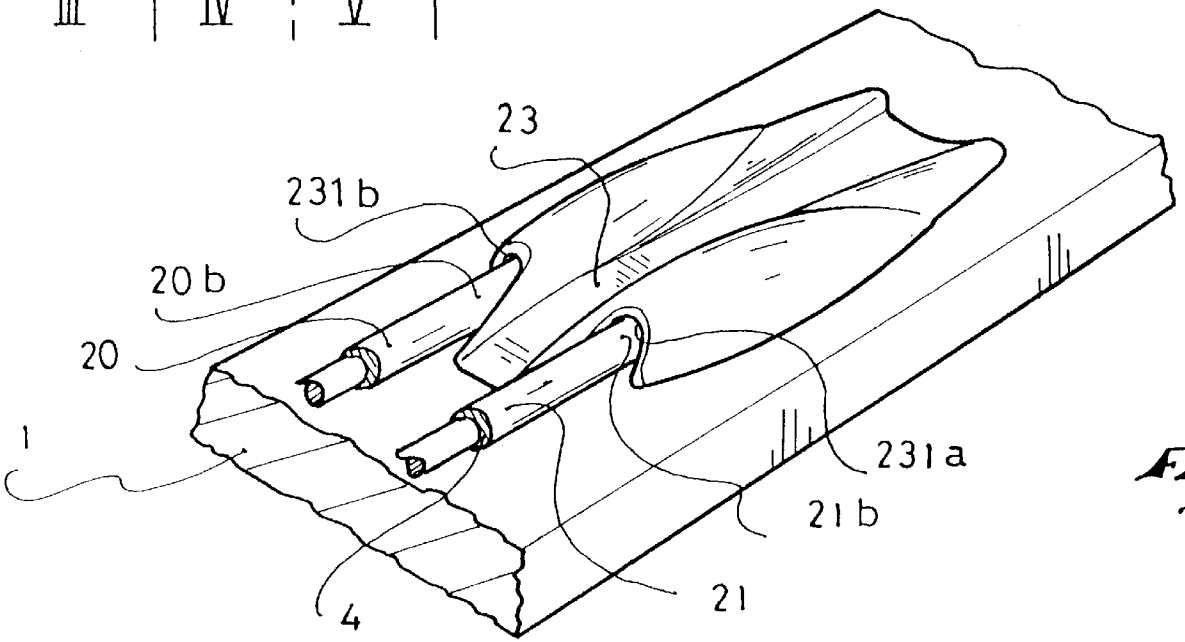
FIG. 2 is an enlarged view of a detail of FIG. 1.

As shown in FIG. 2, the casing 23 includes openings 231*a*, 231*b* to enable introduction of the respective second ends 20*b*, 21*b* of the rods into the casing. These openings must be sufficient for allowing a free translational and rotational sliding.

A recess 230 whose volume must also be sufficient, particularly in depth, is provided within the casing to enable a free translational displacement of each rod. It is particularly important, in effect, that the free end 20*b*, 21*b* of each rod not be capable of coming into abutment against the end 230*a* of the housing in the casing in order to avoid any stiffness of the ski starting from a certain point (FIG. 7).

The volume of the recess 230 is particularly filled with a shock-absorbing block 25 of viscoelastic material. The material is selected, advantageously, from the family of mineral or organic resins. In this case, the material is sufficiently adhesive to adhere to the elements with which it comes into contact in order to sustain substantial shearing during the translational or rotational displacement of ends 21*a*, 21*b* in the recess of the casing.

The shock-absorbing block 25 enters into contact with the tubular sliding surface along a certain length l of the retractable portion or end 20*b*, 21*b* of each rod i.e., the portion that is inserted or positioned within the recess 230 of the housing 23.

The fixed connection 22 is in the form of a second casing adapted to be connected to the ski by any means, such as adhesion, welding, or screwing, and into which the first ends 20*a*, 21*a* of the rods 20, 21 penetrate. These ends 20*a*, 21*a* are connected rigidly to the casing 22 by means of an adhesive layer 220, for example (FIG. 6).

Each rod 20, 21 is preferably made of a high modulus material with a basis of glass, carbon, acrylic or polyester fibers, or of a mixture of said fibers.

The plastic material which contains these fibers may be a thermosetting resin, preferably of the epoxy type, or a thermoplastic resin.

The advantage of utilizing a composite material rather than metal is derived from the low thermal expansion of the composite with respect to the metal and its lightness.

On the other hand, one of the disadvantages of the composite is its low crushing and impact strength. It is therefore necessary to protect each rod with an external sheath 4 made of a flexible plastic material. The sheath must extend along the distance D between the fixed connection 22 and the casing 23. Preferably, such a sheath is made of polyamide, polyurethane, or extruded ionomer.

However, one can also envision the utilization of metallic rods made of stainless steel, aluminum or the like, in particular for intensive use of the device during competition.

For economical reasons, the rods and their sheath have a constant section along the entire length.

Tests have been performed on rods constituted by a hollow tube that has one or more inner glass fiber layers and covered by one or more outer carbon layers. The glass provides a proper crushing strength. With respect to carbon, its usage is justified by its high modulus which enables the external diameters of the tube to remain relatively small; this advantageously limits the space requirement of the device. Of course, the risks of crushing can also be limited by utilizing solid tubes, as shown in the various figures.

Thus, in a general manner, the external diameter of the tubes is comprised between 4 and 8 mm, preferably between 5 and 6 mm.

FIGS. 8 and 9 illustrate the working principle of the device on a ski when a purely torsional deformation occurs in the area covered by the device.

In the resting state shown in FIG. 8, no displacement is recorded. When a torque C is applied, an angular displacement of each free rod end 20*b*, 21*b* is recorded. This rotation is accompanied by the relative coming of the ends closer to the vertical longitudinal plane P, therefore necessarily by a short longitudinal retreat in the housing in the casing. When the torque is released, the ends 21*a*, 21*b* return to their initial position.

These to-and-fro rotational and translational displacements generate shearing forces, and therefore energy dissipation, in the shock-absorbing block.

Figure 10:
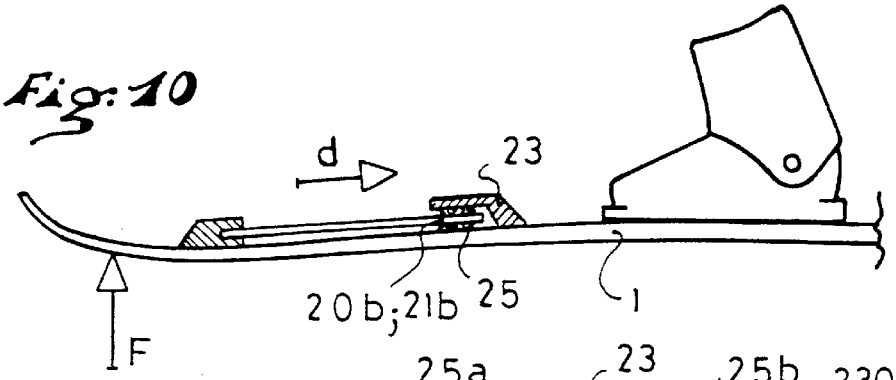
FIG. 10 is a schematic view of the working principle of the device during flexion.

FIG. 10 illustrates the working principle of the device during pure flexion. When a shearing force F is applied to the area of the device in the direction indicated, for example, during a violent impact between the front of the ski shown and the ground, a relative displacement of each free end 20*b*,

21*b* of the rods in the direction of the casing 23 (along the direction of the arrow d) is noted. This displacement is thus braked by the shock-absorbing block 25. Of course, braking and therefore shock-absorption also occur in the opposite relative displacements, i.e. along a direction opposite d, during return movements to the initial position and along a reversed arrow, i.e., along a direction opposite F.

Of course, it is to be understood that the displacements generated are a function of the length of the rods and their shift with respect to the neutral fiber of the ski, and also of the lateral shift of the rods with respect to the vertical median plane P of the ski.

Figure 11:
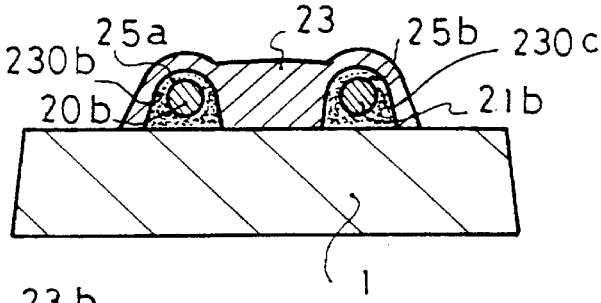
FIG. 11 is a cross-sectional view similar to the view of FIG. 3 according to an alternative embodiment.

FIG. 11 shows a variation of the invention in which the casing 23 includes two separate recesses 230*b*, 230*c* each receiving the end 20*b*, 21*b* of the rods. Each housing is fitted with a distinct shock-absorbing block 25*a*, 25*b*. This embodiment, with respect to the previous one, has the advantage of having a constituent material of the block 25*a* which has different characteristics with respect to the material of the block 25*b* (hardness, resiliency, viscosity, tangent, etc.). One can thus adapt the shock-absorption on the side of the inner running edge of the ski, where the supports are stronger, in a differential and specific manner with respect to the side of the outer running edge of the ski where the supports are weaker.

Figure 12:
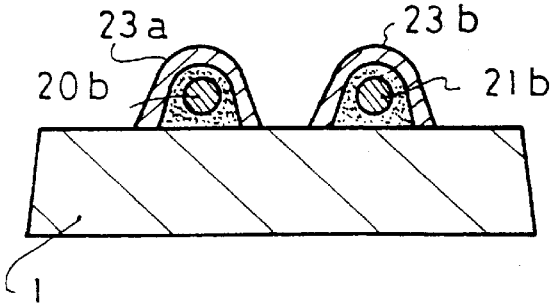
FIG. 12 is a cross-sectional view similar to the view of FIG. 3 according to another alternative embodiment.

FIG. 12 shows another variation where the device includes two distinct casings 23*a*, 23*b* each provided with a distinct recess.

Figure 13:
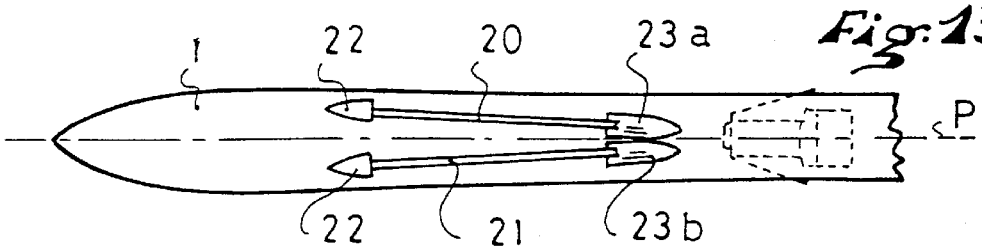
FIG. 13 is a top view of the front of the ski according to the alternative embodiment of FIG. 12.

The rods 20, 21 are not necessarily parallel, but can be divergent toward the ends of the ski, on the front portion of the ski, as shown by way of example in FIG. 13. As in the preceding embodiment, the device can advantageously include two distinct casings 23*a*, 23*b* laterally spaced apart along the width of the front of the ski, as well as two distinct and separate fixed connections 22.

Figure 14:
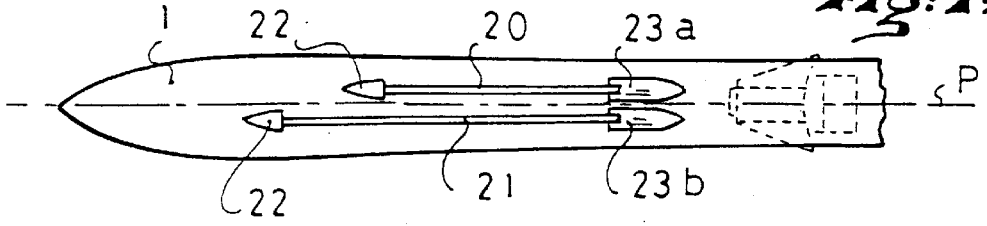
FIG. 14 is a view similar to that of FIG. 13 according to another alternative embodiment.

The rods do not necessarily have the same length but can, on the other hand, have a different length as needed, as shown in FIG. 14, so as to differentially affect the supports on the inner side and outer side of the ski.

Figure 15:
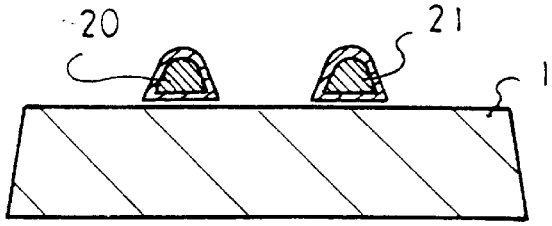
FIG. 15 is a view similar to that of FIG. 4 according to another alternative embodiment.

The rods 20, 21 can have a non-circular shape, such as a flattened, substantially hemicircular shape shown in FIG. 15. Such a shape contributes to lower the neutral fiber of the section of the rod so that it resists better to buckling during bending.

Figure 16:
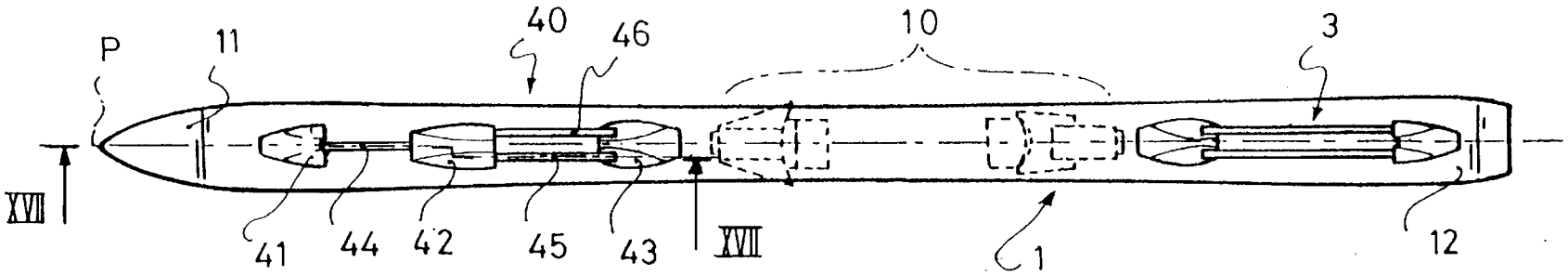
FIG. 16 is a view similar to that of FIG. 1 according to another alternative embodiment.
Figure 17:
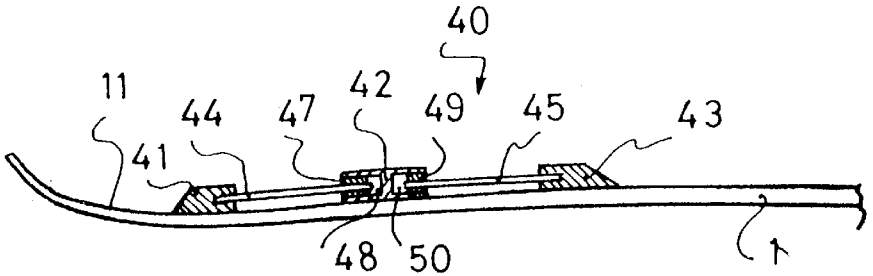
FIG. 17 is a partial schematic cross-section along XVII—XVII of FIG. 16.

Another alternative embodiment shown in FIGS. 16 and 17 calls for three casings and threes rods.

This alternative embodiment is shown in a top view in FIG. 16. The ski 1 includes a device 3, a mounting zone 10, a shovel zone 11 and a tail 12, as has already been described. A device 40 is located between the mounting zone 10 and the shovel zone 11. The device 40 includes a front casing 41, a central casing 42, and a rear casing 43. A rod 44 connects the front casing 41 to the central casing 42, and two rods 45, 46 connect the central casing 42 to the rear casing 43.

The device 40 functions in the following manner, explained by means of FIG. 17.

The rod 44 is affixed through one end to the casing 41 in a fixed manner, for example, by adhesion or screwing in an opening of the casing 41. The other end of the rod 44 is guided in an open cavity of the central casing 42 by a shock-absorbing block 47 arranged between the rod 44 and walls of the cavity. Of course, a space 48 of the cavity enables a displacement of the rod 44 in the cavity without the end of the rod 44 touching the bottom of the cavity when the ski 1 becomes deformed.

Similarly, the rods 45, 46 each have one end fixedly connected to the rear casing 43, and one end that is movable with respect to the casing 42.

The cross section of FIG. 17 shows one end of the rod 45 affixed in an opening of the casing 43, and the other end of the rod 45 is capable of being displaced in a cavity of the casing 42 by friction on a shock absorbing block 49. Of course, a recess 50 of the cavity of the casing 42 prevents the end of the rod 45 from touching the bottom of the cavity when the ski 1 becomes deformed.

The rod 46, not visible in FIG. 17, is connected through its ends to the casings 42 and 43 in a manner similar to the connection of the rod 45 to the same casings 42 and 43.

One can provide to vary the intensity of the shock-absorption of the rods 44, 45, and 46 on their respective shock-absorbing blocks, for example by changing the type of material constituting the shock-absorbing blocks, or by modifying their compression state between the rod and the walls of the cavity, for example by adjusting the dimensions of the parts of the device 40.

This alternative embodiment of the invention makes it possible to manage flexional and torsional deformations in selected areas of the ski 1. In particular, the rod 44 more specifically controls flexional deformations, whereas the rods 45 and 46 control both flexional and torsional deformations.

The invention is not limited to the embodiments which have been expressly described, but it includes the various variations and generalization thereof contained in the claims that follow.

What is claimed is:

1. A shock-absorbing device for a gliding board, said device comprising:

two transmission rods laterally spaced apart, each of said transmission rods having a first end portion and a second end portion, said first end portions constituting fixed end portions and said second end portions constituting movable end portions;

at least one fixed connection adapted to connect said first end portions of said two transmission rods rigidly to the gliding board;

at least one casing adapted to be connected rigidly to the gliding board at a certain distance longitudinally spaced from said fixed connection, said at least one casing having openings through which said second end portions are introduced, each said opening having a size sufficient to permit free translational and rotational sliding of said second end portions, said at least one casing further having at least one recess for housing said second end portions of said two transmission rods, each of said recesses containing a viscoelastic material;

each of said second portions of said transmission rods having a longitudinally extending sliding surface along a certain length and in contact with said viscoelastic material, said second portions of said transmission rods being arranged for rotational and translational movement in said at least one recess and being biased in shearing with said viscoelastic material during said movement wherein:

said two transmission rods are offset relative to one another and operate independently of one another.

2. A shock-absorbing device according to claim 1, wherein:

said two transmission rods are oriented substantially parallel to one another.

3. A shock-absorbing device according to claim 1, wherein:

said at least one casing comprises only a single casing into which said second end portions of said transmission rods extend.

4. A shock-absorbing device according to claim 1, wherein:

said at least one fixed connection comprises a second casing adapted to be connected to the ski by an adhesive, a weld, or screws, and into which said first end portions of said two transmission rods extend.

5. A shock-absorbing device according to claim 1, wherein:

each of said transmission rods is made of a high modulus material made of metal or having a basis of glass, carbon, acrylic or polyester fibers, or of a mixture of such fibers.

6. A shock-absorbing device according to claim 4, wherein said first end portions of said two transmission rods are rigidly connected to said second casing by means of an adhesive layer.

7. A shock-absorbing device according to claim 5, wherein:

between said fixed connection and said casing, each of said transmission rods is protected with an external sheath made of a flexible plastic material.

8. A shock-absorbing device according to claim 5, wherein:

each of said transmission rods is constituted by a hollow tube having one or more inner glass fiber layers and covered by one or more outer carbon layers.

9. A shock-absorbing device according to claim 7, wherein:

each of said sheaths is made of polyamide, polyurethane, or extruded ionomer.

10. A shock-absorbing device according to claim 8, wherein:

each of said hollow tubes has an outer diameter of between 4 and 8 mm.

11. A shock-absorbing device according to claim 8, wherein:

each of said hollow tubes has an outer diameter of between 5 and 6 mm.

12. A shock-absorbing device for a gliding board, said device comprising:

means for absorbing flexional and torsional forces imposed on the gliding board, said means comprises:

two transmission rods laterally spaced apart, each of said transmission rods having a first end portion and a second end portion, said first end portions constituting fixed end portions and said second end portions constituting movable end portions;

at least one fixed connection adapted to connect said first end portions of said two rods rigidly to the gliding board;

at least one casing adapted to be connected rigidly to the gliding board at a certain distance longitudinally spaced from said fixed connection, said at least one casing having openings through which said second end portions are introduced, said at least one casing further having at least one recess for housing said second end portions of said two transmission rods, each of said recesses containing a viscoelastic material;

each of said second portions of said transmission rods having a longitudinally extending sliding surface along a certain length and in contact with said viscoelastic material, said second portions of said transmission rods being arranged for rotational and translational movement in said at least one recess and being biased in shearing with said viscoelastic material during said movement.

13. In combination, a ski and a shock-absorbing device, said shock-absorbing device comprising:

two transmission rods laterally spaced apart, each of said transmission rods having a first end portion and a second end portion, said first end portions constituting fixed end portions and said second end portions constituting movable end portions;

at least one fixed connection connecting said first end portions of said two rods rigidly to said ski;

at least one casing connected rigidly to said ski at a certain distance longitudinally spaced from said fixed connection, said at least one casing having openings through which said second end portions are introduced, said at least one casing further having at least one recess for housing said second end portions of said two transmission rods, each of said recesses containing a viscoelastic material;

each of said second portions of said transmission rods having a longitudinally extending sliding surface along a certain length and in contact with said viscoelastic material, said second portions of said transmission rods being arranged for rotational and translational movement in said at least one recess and being biased in shearing with said viscoelastic material during said movement.

14. The combination according to claim 13, wherein:

said ski is an alpine ski.

15. The combination according to claim 13, wherein:

said ski has a vertical median plane and said transmission rods are oriented substantially longitudinally, each being offset on either side of the vertical median plane.

16. The combination according to claim 13, wherein:

said ski includes a shovel zone, a tail zone, and a binding mounting zone between said shovel zone and said tail zone;

said device is located between said shovel zone and said binding mounting zone;

said combination further comprising a second shock-absorbing device located between said binding mounting zone and said tail zone.

17. The combination according to claim 13, wherein:

said two transmission rods are oriented substantially parallel to one another.

18. The combination according to claim 13, wherein:

said at least one casing comprises only a single casing into which said second end portions of said transmission rods extend.

19. The combination according to claim 13, wherein:

said at least one fixed connection comprises a second casing adapted to be connected to the ski by an adhesive, a weld, or screws, and into which said first end portions of said two transmission rods extend.

20. The combination according to claim 13, wherein:

each of said transmission rods is made of a high modulus material made of metal or having a basis of glass, carbon, acrylic or polyester fibers, or of a mixture of such fibers.

21. The combination according to claim 19, wherein:

said first end portions of said two transmission rods are rigidly connected to said second casing by means of an adhesive layer.

22. The combination according to claim 20, wherein:

between said fixed connection and said casing, each of said transmission rods is protected with an external sheath made of a flexible plastic material.

23. The combination according to claim 20, wherein:

each of said transmission rods is constituted by a hollow tube having one or more inner glass fiber layers and covered by one or more outer carbon layers.

24. The combination according to claim 22, wherein:

each of said sheaths is made of polyamide, polyurethane, or extruded ionomer.

25. The combination according to claim 23, wherein:

each of said hollow tubes has an outer diameter of between 4 and 8 mm.

26. The combination according to claim 23, wherein:

each of said hollow tubes has an outer diameter of between 5 and 6 mm.

* * * * *